US006945572B1

(12) United States Patent
Hauber

(10) Patent No.: US 6,945,572 B1
(45) Date of Patent: Sep. 20, 2005

(54) SLIDING DOOR LATCH ASSEMBLY

(75) Inventor: Peter Hauber, Buellton, CA (US)

(73) Assignee: Builder's Hardware, Inc., Buellton, CA (US)

( * ) Notice: Subject to any disclaimer, the term of this patent is extended or adjusted under 35 U.S.C. 154(b) by 0 days.

(21) Appl. No.: 09/613,294

(22) Filed: Jul. 10, 2000

Related U.S. Application Data

(60) Provisional application No. 60/214,493, filed on Jun. 27, 2000.

(51) Int. Cl.[7] ..... E05C 19/10

(52) U.S. Cl. ..... 292/97; 292/26; 292/123; 292/DIG. 46; 70/95; 49/449

(58) Field of Search ..... 292/97, DIG. 46, 292/26, 123; 70/95; 49/449

(56) References Cited

U.S. PATENT DOCUMENTS

| | | | | | |
|---|---|---|---|---|---|
| 998,642 | A | * | 7/1911 | Shean | 292/36 |
| 1,090,057 | A | * | 3/1914 | Hill | 70/210 |
| 3,046,776 | A | * | 7/1962 | Marotto et al. | 70/97 |
| 3,177,687 | A | * | 4/1965 | Tucker | 70/97 |
| 3,353,855 | A | * | 11/1967 | Smith | 292/65 |
| 3,413,025 | A | * | 11/1968 | Sperry | 292/111 |
| 4,362,328 | A | * | 12/1982 | Tacheny et al. | 292/36 |
| 4,639,021 | A | * | 1/1987 | Hope | 292/7 |
| 4,643,005 | A | * | 2/1987 | Logas | 70/95 |
| 4,973,091 | A | * | 11/1990 | Paulson et al. | 292/51 |
| 5,092,144 | A | * | 3/1992 | Fleming et al. | 70/95 |
| 5,125,703 | A | * | 6/1992 | Clancy et al. | 292/337 |
| 5,174,617 | A | * | 12/1992 | Huber et al. | 292/128 |
| 5,388,875 | A | * | 2/1995 | Fleming | 292/37 |
| 5,582,442 | A | * | 12/1996 | Nolte | 292/101 |
| 5,722,704 | A | * | 3/1998 | Chaput et al. | 292/26 |
| 5,775,749 | A | * | 7/1998 | Reithmeyer et al. | 292/341.18 |
| 5,820,170 | A | * | 10/1998 | Clancy | 292/26 |
| 5,906,403 | A | * | 5/1999 | Bestler et al. | 292/26 |
| 6,264,252 | B1 | * | 7/2001 | Clancy | 292/196 |
| 6,327,879 | B1 | * | 12/2001 | Malsom | 70/97 |

* cited by examiner

*Primary Examiner*—Daniel P. Stodola
*Assistant Examiner*—Carlos Lugo
(74) *Attorney, Agent, or Firm*—Louis J. Bachand

(57) ABSTRACT

A sliding door has a latch assembly and a vertically disposed pull handle that would normally interfere with convenient operation of the latch lever. A rotatable latch lever is located beyond the handle and a rotatable latch is located opposite the handle. A 4-bar coupling extends between the lever and the latch so that the latch is conveniently rotatable from beyond the pull handle for engaging a cooperating keeper.

11 Claims, 2 Drawing Sheets

FIG. 2B
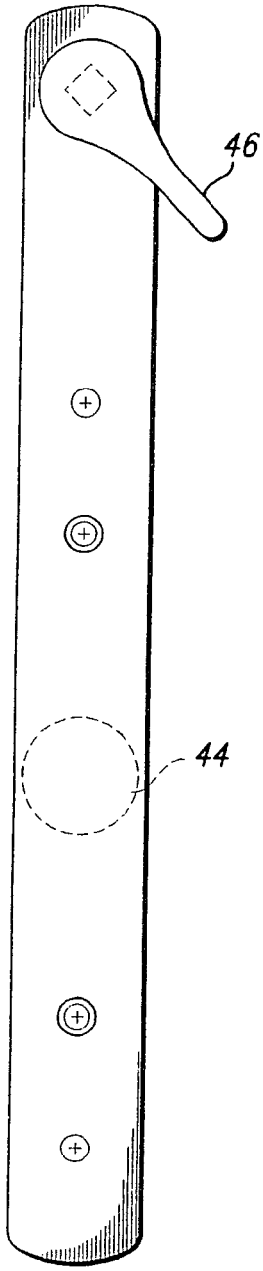
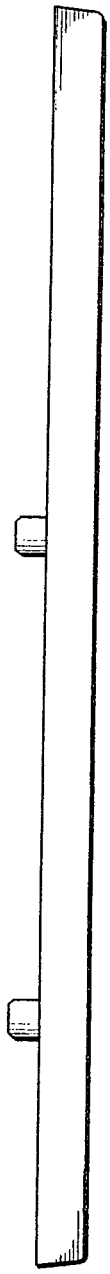
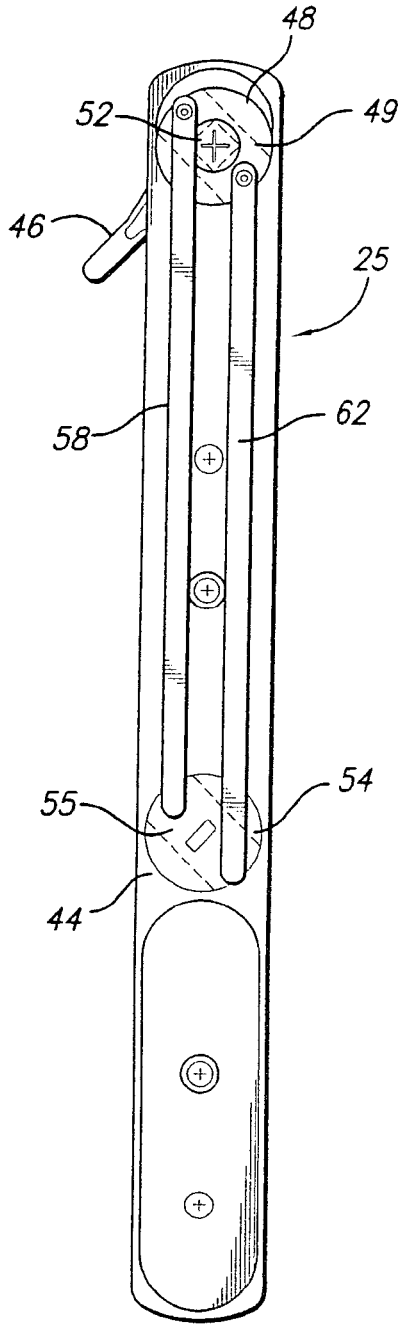
FIG. 2A
FIG. 2C

SLIDING DOOR LATCH ASSEMBLY

CROSS-REFERENCE TO RELATED APPLICATIONS

This application claims the benefit of U.S. Provisional application Ser. No. 60/214,493, filed Jun. 27, 2000.

STATEMENT REGARDING FEDERALLY SPONSORED RESEARCH OR DEVELOPMENT

Not Applicable

REFERENCE TO A MICROFICHE APPENDIX

Not Applicable

BACKGROUND OF THE INVENTION

1. Field of the Invention

This invention relates to sliding door latch assemblies, and more particularly to the combination of a sliding door and latch assembly in which the latch, although behind or under the door pull handle, is conveniently operated by having the lever that operates the latch mounted beyond the area of the handle, and coupled to the latch by an elongated mechanism that translates the rotary action of the lever to rotary shifting of the latch from beyond the handle area.

2. Description of the Related Art

Sliding doors have leading stiles that fit to the doorjamb. The door lock comprises a latch that interfits with a keeper in the doorjamb. Sliding doors are heavy and may not slide easily after a time. Typical handles provide for but a finger hold to move the door. Accordingly, better, larger handles are required, but there is little space on the latch assembly for the handle unless the area over the latch actuation mechanism is used. This handle placement, however, leads to difficulties in operating the mechanism in its hidden and difficult to reach location.

BRIEF SUMMARY OF THE INVENTION

It is an object of the invention to enable the use in sliding doors of larger handles that can be gripped by more than the fingertips while avoiding the difficulties that such placement of the handle causes when the handle in order to be adequate in size and shape tends to block the hand movement needed to reach the latch and latch lever. It is a further object to eliminate the resultant interference with latch operation and door locking and unlocking that use of larger handles has precipitated.

It is another object of the invention to provide a sliding door and latch assembly that provides a large handle for door shifting but is readily latched as well. It is a further object to provide an improved latch assembly that is accessible despite the presence of the larger handle. It is a still further object to provide a sliding door latch assembly that vertically spaces the latch and the latch lever such that the lever is accessible beyond the handle while the latch is within the housing locus where the handle is located. It is a further and specific object to provide an elongated, vertically disposed 4-bar coupling of the spaced latch and lever that translates the rotation of the lever into rotation of the latch for shifting the latch into or out of latching relation with the latch keeper.

These and other objects of the invention to become apparent hereinafter are realized in a sliding door latch assembly comprising a vertically extended housing having a vertically disposed pull handle opposite a housing locus extending over a major portion of but not all of the vertical extent of the housing, a latch mounted within the housing locus and shiftable to and from the housing for locking the sliding door to a cooperating keeper mounted in a sliding doorjamb opposite the latch, a rotary actuator within the housing locus for shifting the latch, a hand-operated lever rotatably mounted to the housing beyond the housing locus, the lever being vertically spaced a predetermined distance from the rotary actuator, the lever being rigidly linked to the rotary actuator for rotatably actuating the latch by the rotatable lever without having the lever within the housing locus, whereby hand actuation of the lever and latch is free of interference from the pull handle.

In this and like embodiments, typically, the latch is hook-shaped and the cooperating keeper comprises a slot; the housing is rectangular in cross-section; the lever further includes a rotatable lever plate, the lever plate and the lever being mounted to a common pivot for rotation together responsive to hand operation of the lever; the rotary actuator comprises a rotatable latch plate, the latch plate and the latch being mounted to a common pivot for rotation together responsive to actuation of the latch plate by the lever; the lever further comprises a rotatable lever plate, the lever plate and the lever being mounted to a common pivot for rotation together responsive to actuation of the latch plate by the lever, the lever plate and the latch plate being rigidly coupled such that rotation of the lever plate causes a like rotation in the latch plate and the latch, there is also included a pair of bars movably fixed to and extending between the lever plate and the latch plate, the bars being arranged to transmit rotary movement of the lever plate to the latch plate, and the bars are of a length to extend from within the housing locus to beyond the housing locus and across the predetermined vertical distance.

In a further embodiment, the latch is hook-shaped and the cooperating keeper comprises a slot, the housing is rectangular in cross-section and comprises front, rear and side walls, the front wall being slotted to pass the latch in shifting relation to and from the keeper, the side walls supporting the latch assembly, the pull handle is an inside handle sized for grasping with several fingers, and including also an outside handle fixed to the housing, and there is also included a sliding door having a leading stile, the leading stile defining the housing.

In a further embodiment, the invention provides a sliding door and latch assembly having a vertically disposed pull handle, a rotatable latch lever beyond the handle and a rotatable latch opposite the handle, and a 4-bar coupling between the lever and the latch, whereby the latch is rotatable from beyond the pull handle for engaging a cooperating keeper.

BRIEF DESCRIPTION OF THE SEVERAL VIEWS OF THE DRAWINGS

The invention will be further described in conjunction with the attached drawings in which:

FIG. 2A is a top plan view of the latch assembly;

FIG. 2B is a side elevation view thereof; and

FIG. 2C is a bottom plan view thereof.

DETAILED DESCRIPTION OF THE INVENTION

Figure 1:
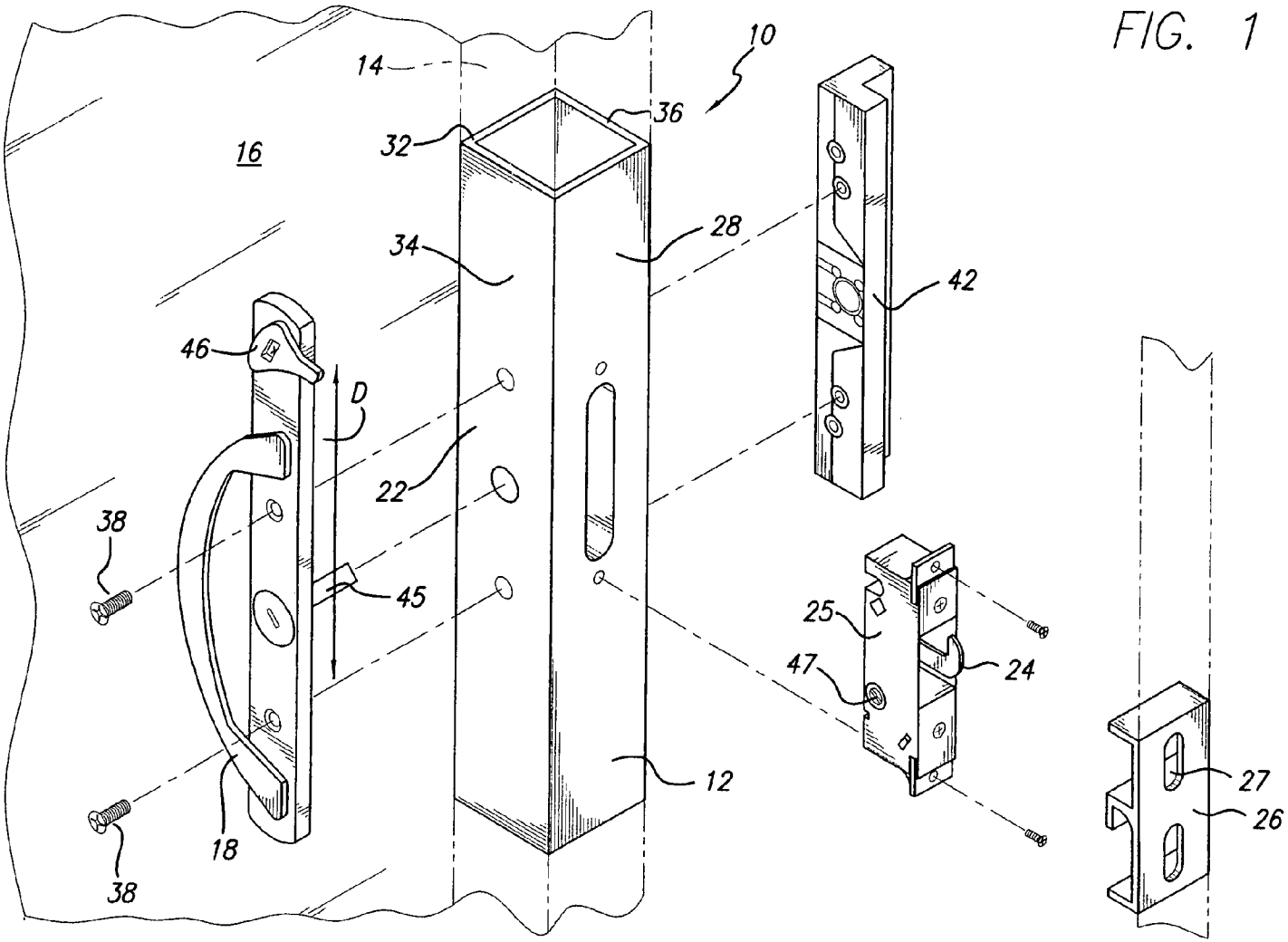
FIG. 1 is an exploded view of the invention sliding door latch assembly, partly broken away to show underlying parts.

With reference now to the drawings in detail, in FIGS. 1 and 2 the invention sliding door latch assembly, generally indicated at 10, comprises a vertically extended housing 12 that is suitably a portion of the leading stile 14 of the sliding door 16. Housing 12 has a vertically disposed pull handle 18 opposite a housing locus 22 extending over a major portion of but not all of the vertical extent of the housing. The latch 24 proper extends from latch housing 25 that is mounted within the housing locus 22, the latch being is shiftable to and from the housing for locking the sliding door to a cooperating keeper 26 mounted in a sliding door jamb opposite the latch.

The latch 24 is suitably hook-shaped; its cooperating keeper 26 comprises a slot 27 sized to receive and retain the latch hook portion. Housing 12 is suitably rectangular in transverse cross-section and comprises front wall 28, rear wall 32, and side walls 34, 36. Housing front wall 28 is slotted to pass the latch 24 in shifting relation to and from the keeper 26. Side walls 34, 36 support the latch housing 25 in position through mounting screws 38. Pull handle 18 defines the door inside handle and is sized for encirclement by and grasping with several fingers. An outside handle 42 is also fixed to the housing 12 to complete the door and latch assembly.

It will be noted that the handle 18 covers much of the housing locus 22, and will cover a latch-operating lever that is in the typical position. The invention places the latch 24 in the typical position in housing locus 22, but moves the latch operating lever to a position that is not behind or covered over by the handle 18. For this purpose the invention uses a 4-bar linkage 25 that transmits the rotary motion of the lever to the latch actuator as follows: A rotary actuator 44 located within the housing locus 22 serves to shift the latch 24 in locking and unlocking relation by rotation of shaft 45 in latch housing slot 47. A hand-operated lever 46 is rotatably mounted to the housing 12 beyond the housing locus 22. Lever 46 is vertically spaced a predetermined distance D from the rotary actuator 44 and rigidly linked to the rotary actuator for rotatably actuating the latch 24 by the rotatable lever without having the lever within the housing locus 22. Thus, hand actuation of the lever 46 and shifting of the latch 24 is free of interference from the pull handle 18.

Lever 46 includes a rotatable lever plate 48, the lever plate and the lever being mounted to a common pivot, shaft 52, for rotation together responsive to hand operation of the lever. The rotary actuator 44 comprises a rotatable latch plate 54, the latch plate and the latch being mounted to a common pivot, shaft 45, for rotation together responsive to actuation of the latch plate by the lever 46 and its rotatable lever plate 48. Lever plate 48 defines a first bar 49, and lever plate 54 defines a second bar 55. Bars 58, 62 define third and fourth bars of the 4-bar linkage 25. Bars 58, 62 are movably fixed to bars 49, 55 at either edge of the lever and latch plates 48, 54, respectively, and extending therebetween, so as to transmit rotary movement of the lever plate to the latch plate. It will be noted the bars 58, 62 are of a length to extend from within the housing locus 22 to beyond the housing locus and across the predetermined vertical distance D.

The invention thus provides a sliding door and latch assembly that provides a large handle for door shifting but is readily latched as well, and an improved latch assembly that is accessible despite the presence of the larger handle that vertically spaces the latch and the latch lever such that the lever is accessible beyond the handle while the latch is within the housing locus where the handle is located. In particular, the invention provides an elongated, vertically disposed 4-bar coupling of the spaced latch and lever that translates the rotation of the lever into rotation of the latch for shifting the latch into or out of latching relation with the latch keeper. The foregoing objects are thus met.

I claim:

1. A sliding door latch assembly comprising a vertically extended housing having a vertically extended major portion, a pull handle opposing said housing major portion, a latch mounted within said housing major portion and shiftable to and from said housing for locking a sliding door to a cooperating keeper mounted in a sliding door jamb opposite said latch, a rotary actuator within said housing major portion for shifting said latch, a hand operated lever rotatably mounted to said housing beyond said housing major portion, said lever being linked from beyond said housing major portion to said rotary actuator within said housing major portion for rotatably actuating said latch by said rotatable lever from beyond said housing major portion, whereby hand actuation of the lever and latch is free of interference from said pull handle, said rotary actuator comprising a rotatable latch plate, said latch plate and said latch being mounted to a common pivot for rotation together responsive to actuation of said latch plate by said lever.

2. The sliding door latch according to claim 1, in which said lever further comprises a rotatable lever plate, said lever plate and said lever being mounted to a common pivot for rotation together responsive to actuation of said latch plate by said lever, said lever plate and said latch plate being rigidly coupled such that rotation of the lever plate causes a like rotation in said latch plate and said latch.

3. The sliding door latch according to claim 2, including also a pair of bars having first ends movably fixed to said lever plate in diametrically opposed relation, said bars having second ends movably fixed to said latch plate in diametrically opposed relation, said bars extending between said lever plate and said latch plate and arranged to transmit rotary movement of said lever plate to said latch plate.

4. The sliding door latch according to claim 3, in which said bars are of a length to extend from within said housing major portion to beyond said housing locus.

5. The sliding door latch according to claim 4, in which said latch is hook-shaped and said cooperating keeper comprises a slot.

6. The sliding door latch according to claim 5, in which said housing is rectangular in cross-section and comprises front, rear and side walls, said front wall being slotted to pass said latch in shifting relation to and from said keeper, said side walls supporting said latch assembly.

7. The sliding door latch according to claim 6, in which said pull handle is an inside handle, and including also an outside handle fixed to said housing.

8. The sliding door latch according to claim 7, including also a sliding door having a leading stile, said leading stile defining said housing.

9. A sliding door latch assembly comprising a vertically extended housing having a major vertically extended portion, a vertically disposed pull handle opposing said housing major portion, a latch mounted within said housing major portion and shiftable to and from said housing for locking a sliding door to a cooperating keeper mounted in a sliding doorjamb opposite said latch, a rotary actuator within said housing major portion for shifting said latch, a hand-operated lever rotatably mounted to said housing beyond said housing major portion, said rotary actuator comprising a rotatable latch plate arranged for rotation responsive to actuation of said latch plate by said lever, a linkage extending from said rotary actuator within said housing major portion to said lever beyond said housing major portion for rotatably actuating said latch by said lever, whereby hand actuation of the lever and latch is free of interference from said pull handle said lever further comprising a rotatable lever plate arranged for rotation responsive to actuation of said latch plate by said lever, said lever plate and said latch plate being coupled such that rotation of the lever plate causes rotation of said latch plate and said latch.

10. The sliding door latch according to claim 9, including also a pair of bars movably fixed to and extending between said lever plate and said latch plate, said bars being arranged to transmit rotary movement of said lever plate to said latch plate.

11. The sliding door latch according to claim 10, in which said bars are generally parallel, said lever plate defines a bar between said bars of said bar pair, and said latch plate defines a further bar between said bars of said bar pair are of a length to extend from within said housing major portion to beyond said housing.

* * * * *